United States Patent [19]

Bramhall et al.

[11] Patent Number: 4,821,648

[45] Date of Patent: Apr. 18, 1989

[54] HOPPER CAR COVER

[75] Inventors: Dan E. Bramhall; Ken L. Kneebone, both of Neodesha, Kans.

[73] Assignee: Fiberglass Engineering Incorporated, Neodesha, Kans.

[21] Appl. No.: 130,649

[22] Filed: Dec. 10, 1987

[51] Int. Cl.[4] ..... B61D 39/00

[52] U.S. Cl. ..... 105/377; 296/901

[58] Field of Search ..... 105/377; 296/100, 210, 296/31 P, 32; 52/45, 50; 114/201 R

[56] References Cited

U.S. PATENT DOCUMENTS

| | | | |
|---|---|---|---|
| 4,245,565 | 1/1981 | Stark | 105/377 |
| 4,452,150 | 6/1984 | Dominguez | 105/377 |
| 4,524,700 | 6/1985 | Engdahl | 105/377 |
| 4,644,874 | 2/1987 | Kleykamp | 105/377 |

*Primary Examiner*—Richard A. Bertsch

*Attorney, Agent, or Firm*—Kokjer, Kircher, Bradley, Wharton, Bowman & Johnson

[57] ABSTRACT

A cover for closing the opening of a railroad hopper car which is adapted to be hingedly coupled to the car is the subject of the invention. The cover is constructed so as to provide a degree of flexibility which increases the ability of the cover to withstand downward vertical forces. The cover comprises a member which presents a generally vertical side wall section that extends around the car opening and a top wall that is integral with the side wall and extends over the opening. The cover is formed in a generally arcuate configuration along a line passing through a horizontal plane and extends away from the plane at a first angle of curvature. A generally flat area along the top wall of the cover is formed in a generally arcuate configuration along a line passing through the same reference horizontal plane while extending away from this plane at an angle of curvature that is greater than the first mentioned angle of curvature. The result is a cover which will firmly seal the hopper car opening and, even when the ends of the cover are forced downward in a closed position, the curved flat area of the top wall will continue to exert a downward force which will assure sealing of the center of the cover away from the clamped ends.

7 Claims, 2 Drawing Sheets

HOPPER CAR COVER

This invention relates generally to railroad hopper cars and, more particularly, to a hopper car cover constructed of flexible fiberglass material.

Railroad hopper cars are provided with open tops for loading material into the cars. Because the covers are frequently opened and closed during the filling operation as well as subsequent inspection operations, it has become commonplace to utilize fiberglass covers which are lighter and more durable than many metal covers.

Prior art fiberglass covers have concentrated on providing a strong rigid construction which will stand up to the demanding usage encountered on a railroad hopper car including persons walking on the covers and objects being thrown or falling onto moving cars.

The hopper car covers of the prior art are held closed by strap type hinged closures which extend completely across the cover to hold it down. It is also known to provide the hopper car covers made of fiberglass with a slight concave bend from the ends of the cover toward the center so as to result in a very strong tight fit when the closure members are forced down against the ends of the cover. Placement of the bow in a cover and actual construction of the cover must take into consideration the fact that placing a downward force on the ends of the cover will have a tendency to raise the cover in the middle where it is bowed downward. Care must be taken to design the bow in a cover so that it will remain sealed even when downward forces are applied at the bowed ends of the cover.

A primary object of the present invention is to provide a hopper car cover which is intentionally designed to flex rather than be rigid as is the case with prior art covers.

As a corollary to the above object, an aim of the invention is to provide a hopper car cover which, as a result of being flexible, is able to better withstand downward vertical forces than rigid covers of the prior art.

It is also a very important objective of our invention to provide a hopper car cover that is flexible and can be manufactured with less material because there is no need to impart rigidity to the cover.

Still another one of the objectives of the invention is to provide a hopper car cover which reduces the number of bends in the cover thereby resulting in a cover which is less rigid and can also be made less expensively because less labor is required to roll out the bends in the fiberglass construction.

It is also an object of this invention to provide a flexible hopper car cover which is provided with double curvilinear surfaces thus resulting in a better sealing characteristic than has been the case with prior art covers where only a single curvature in the cover is employed.

We also have as an objective of our invention to provide a hopper car cover which has fewer bends and reduced flat areas than prior art covers thereby reducing the problem of ice buildup on the cover when temperatures are below freezing.

Other objects of the invention will be made clear or become apparent from the following description and claims when read in light of the accompanying drawing wherein:

Figure 4:
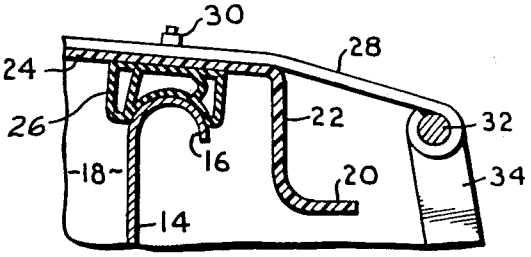
FIG. 4 is a fragmentary vertical cross-sectional view on an enlarged scale showing the hinge mount for the cover and the sealing strip between the cover and the hopper car.
Figure 1:
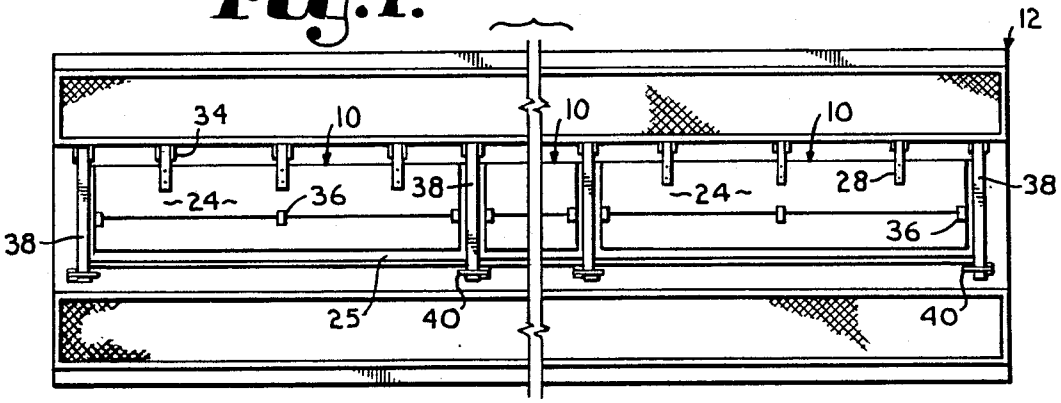
FIG. 1 is a top plan view of a hopper car cover according to the present invention.

The hopper car cover of the present invention is designated generally by the numeral 10 in FIGS. 1 through 5 and is placed on top of a railroad hopper car, shown fragmentarily in FIG. 1 and designated by the numeral 12. Referring to FIG. 4, hopper car 12 includes a top upright wall 14 terminating in a curved flange portion 16 which defines an opening in the top of the car designated by the numeral 18.

Opening 18 is closed by cover 10 which is formed of resin impregnated glass fiber. Cover 10 is constructed so that it is flexible and comprises a first generally flat apron section 20 which surrounds the opening formed by vertical wall 14. As is apparent from FIG. 4, apron section 20 is disposed in spaced-apart relationship relative to wall 14 with the plane of the apron section being below the top surface of flanged portion 16.

Apron section 20 is integral with and merges into a crown section that is formed by a generally vertical side wall 22 and a top wall 24. As can be seen from FIGS. 1 and 5, the overall configuration of cover 10 is generally rectangular so as to match the configuration of opening 18. It is to be particularly noted that top wall 24 presents a smooth uninterrupted surface with no 90° bends except where the top wall merges into vertical wall 22.

Secured to the underside of top wall 24 in a location so as to mate with car flanged portion 16 is a deformable rubber gasket 26. Gasket 26 extends around the underside of top wall 24 so as to assure an uninterrupted seal between the cover and the hopper car.

At the back side of cover 10 a plurality of hinges 28 are mounted to top wall 24 by nut and bolt assemblies 30. Each hinge 28 also has a hinge pin 32 which couples it with a lower hinge bracket 34 which in turn is mounted on railroad car 12. The top wall 24 of the cover is provided with rubber bumpers 36 which cushion the cover when it is moved 180° to its full open position.

Figure 2:
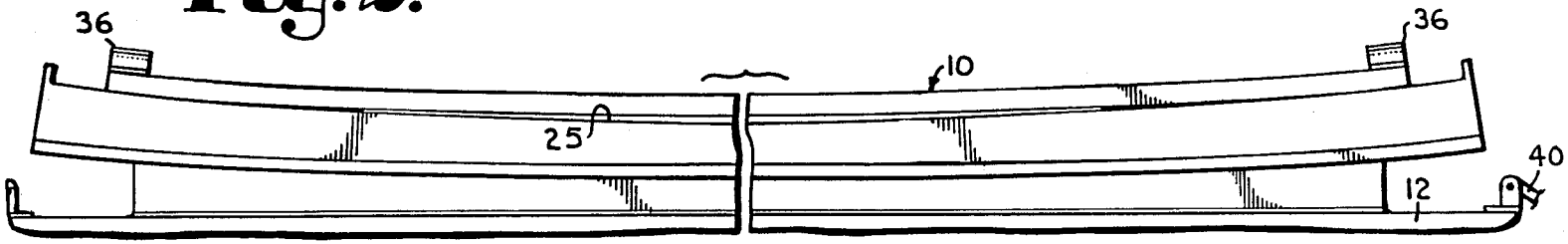
FIG. 2 is a side elevational view of the cover according to the present invention with the angle of curvature being greatly exaggerated.
Figure 5:
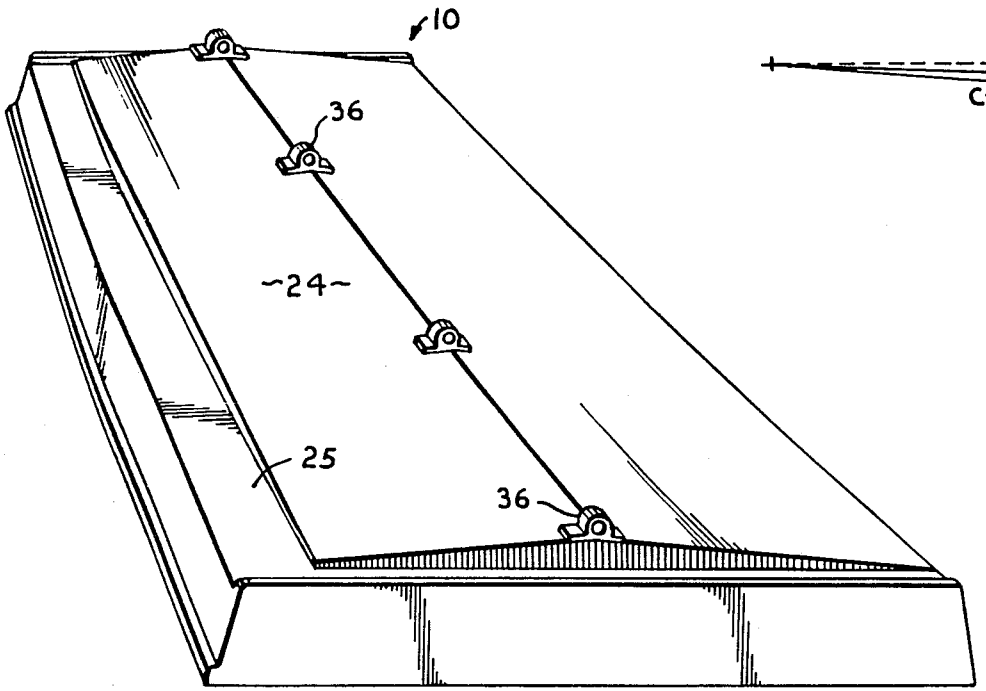
FIG. 5 is a perspective view of the cover according to the present invention.

As illustrated in FIGS. 2 and 5, the side of top wall 24 which is opposite the side where hinges 28 are attached, i.e. the front or opening side, is provided with a generally flat planar lip 25 which extends in a downward concave arc from the primary surface of wall 24. The arc presented by lip 25 is a catenary curve which optimizes the equalization of forces over the lip when the cover is closed. The line of curvature of the curvilinear surface 25 is shown schematically in FIG. 6. An imaginary horizontal plane is represented by the broken line A and this plane would extend parallel to the plane at the top of opening 18. The angle of curvature which surface 25 makes with plane A is designated by the angle B in FIG. 6. It should be understood that the angle of curvature B is the angle made by a tangent to the arc of curvature at the point where the curve intersects horizontal plane A.

The entire cover 10 also follows an arc that passes through the same imaginary horizontal plane A as the first arc referenced above. The ends of the second arc are substantially coterminous with the ends of the first arc but the second arc formed by the overall curvature of the cover 10 is at an angle of curvature C (FIG. 6) which is smaller than the angle of curvature B discussed above. The angle of curvature C is illustrated in FIG. 6 and is represented by a line which can be viewed as passing through the vertical center of cover 10 and extending over its length to a point of intersection with horizontal plane A.

Figure 6:
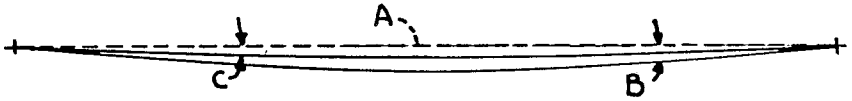
FIG. 6 is a schematic illustration on an enlarged scale of the two angles of curvature which are built into the cover.

It is to be emphasized that the angles A and B illustrated in FIG. 6 are greatly exaggerated for purposes of clarity and illustration and in actual practice the maximum concavity of the line of curvature of the entire cover 10 would be 3/16±1/16 of an inch in an overall length of approximately 12–15 feet. The maximum concavity of the line of curvature of curvilinear planar surface 25 would be ½ inch±1/16 inch over a total length of 12–15 feet. The ratio of the maximum concavity of curvilinear surface 25 relative to the maximum concavity of the overall cover 10 should be maintained in a ratio of approximately 1.25:1 to 1.5:1.

In use, when cover 10 is used to close opening 18, it is locked in its closed position by U-shaped hold-down bars 38 which are placed at each end of cover 10. Hold-down bars 38 are hingedly mounted to car 12 and are locked into their cover holding positions by overcenter clamps 40.

Figure 3:
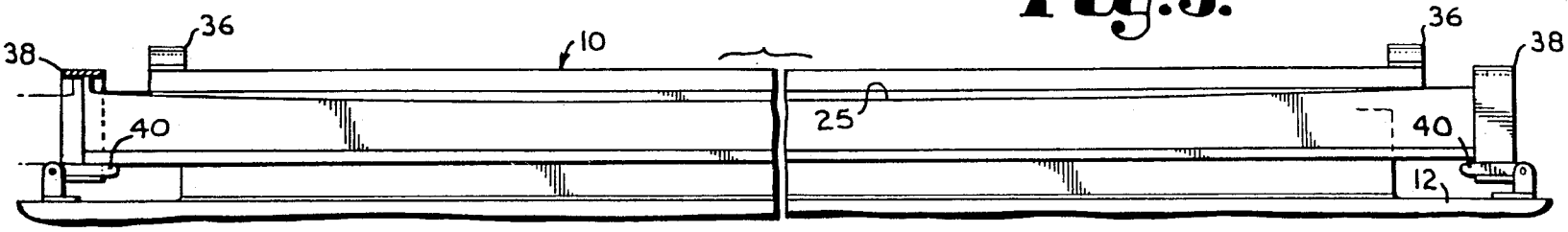
FIG. 3 is an elevational view of the cover of the invention in its closed and clamped down position.

When the ends of the cover are clamped down, the angle of curvature in the overall cover will be substantially eliminated and the cover will assume a generally horizontal planar configuration as illustrated in FIG. 3. The curvature in surface 25 will remain, however, and this line of curvature which originally formed a catenary curve exerts a downward force substantially uniform in magnitude over the length of the cover to assure good sealing contact between the cover and the flanged portion 16. This downward force is sufficient to overcome any tendency of the overall cover to move upward at the center as a result of the ends of the cover being pulled downwardly by hold-down bars 38.

By virtue of the relatively smooth surface of top wall 24 and a greatly reduced number of 90 degree bends in the overall cover, relative to the prior art covers, savings are realized in both labor and material in constructing the cover. Also, the absence of flat areas for mounting hinges 28 reduces ice buildup on the cover during freezing weather. The cover is intentionally designed so that it is not as rigid as prior art covers but as a result thereof it is better able to withstand forces exerted downwardly on the cover including the weight of persons walking over the cover and objects which may be thrown or fall onto a moving railroad car.

We claim:

1. A cover for closing the opening of a railroad hopper car and adapted to be hingedly coupled to the car, said cover comprising:

a member having an overall arcuate configuration presenting a vertical side wall section extending around the periphery of that portion of said car presenting said opening and a top wall integral with said side wall and extending over said opening, said arcuate configuration of said member being generally concave with respect to a line passing through a horizontal plane at a first angle of curvature; and a section of said top wall having an arcuate configuration and located at the side opposite the hinged coupling.

said arcuate configuration of said section being generally concave with respect to a line passing through a horizontal plane at an angle of curvature that is greater than said first angle of curvature, said line of curvature of said section presenting a catenary curve.

2. The invention of claim 1, wherein said cover is adapted to be held closed by two means extending across said cover at opposite ends, said second angle of curvature being sufficient to cause said flat area to exert a downward force on said hopper car when said means is in its holding position.

3. The invention of claim 2, wherein is included means secured to the inside of said cover for sealing the area between said portion of the car presenting said opening and said cover.

4. The invention of claim 1, wherein is included means for hingedly coupling said cover with said car.

5. The invention of claim 1, wherein said cover member includes a generally horizontal skirt integral with said side wall around the periphery of the latter.

6. The invention of claim 1, wherein said top wall is characterized by a continuous uninterrupted surface between said flat area and the edge where said hinged coupling is mounted.

7. The invention of claim 1, wherein said member comprises a flexible material.

* * * * *